United States Patent [19]

Stull

[11] Patent Number: 4,546,893

[45] Date of Patent: Oct. 15, 1985

[54] TAMPER-EVIDENT CLOSURE CAP CONSTRUCTION

[76] Inventor: Gene Stull, 5 Oak St., Chester, N.J. 07930

[21] Appl. No.: 663,549

[22] Filed: Oct. 22, 1984

[51] Int. Cl.[4] ..... B65D 1/02

[52] U.S. Cl. ..... 215/252; 215/253; 215/256

[58] Field of Search ..... 215/252, 250, 253, 256, 215/203, 31, 251, 258; 220/257, 265, 266, 268

[56] References Cited

U.S. PATENT DOCUMENTS

| | | | |
|---|---|---|---|
| 2,125,788 | 8/1938 | Johnson | 215/31 X |
| 2,987,206 | 6/1961 | Grussen | 215/250 |
| 3,465,906 | 9/1969 | Wagner et al. | 215/253 |
| 3,650,428 | 3/1972 | Miller | 215/252 |
| 3,673,761 | 7/1972 | Leitz | 215/253 X |
| 4,352,436 | 10/1982 | Chartier et al. | 215/252 |
| 4,385,708 | 5/1983 | Curry | 215/256 |
| 4,402,415 | 9/1983 | Hopley | 215/256 X |
| 4,478,343 | 10/1984 | Ostrowsky | 215/252 |
| 4,485,934 | 12/1984 | Maguire | 215/252 |
| 4,494,663 | 1/1985 | Bertaud et al. | 215/250 X |
| 4,513,870 | 4/1985 | Zaltsman | 215/253 X |

FOREIGN PATENT DOCUMENTS

| | | | |
|---|---|---|---|
| 1511582 | 5/1978 | United Kingdom | 215/250 |

*Primary Examiner*—Steven M. Pollard
*Attorney, Agent, or Firm*—H. Gibner Lehmann; K. Gibner Lehmann

[57] ABSTRACT

A tamper-evident plastic closure cap construction which is intended to provide to the consumer a distinctive visual alerting indication in the event that the container has been previously opened or tampered with, comprising a closure portion and a base portion, the latter being snapped into position on the container and held permanently thereon by means of cooperable retainer shoulders. The closure portion seals off the dispensing orifice of the container in a usual manner. Joining the closure portion to the base portion are multiple frangible webs associated with an indicator ring which normally occupies a first or depressed position prior to opening of the container. When the closure portion is initially turned or otherwise disturbed, the frangible webs break, and their resilience causes the ring to shift laterally by a significant amount to a second or raised position, which attracts the attention of one handling the container. The ring thus provides a more pronounced indication of possible tampering than all previous constructions which depended solely on breakage of one or more relatively small webs to reveal tampering.

20 Claims, 14 Drawing Figures

TAMPER-EVIDENT CLOSURE CAP CONSTRUCTION

BACKGROUND

This invention relates generally to plastic closure cap constructions, and more particularly to devices of this type which provide a visual indication if unauthorized use of or tampering with the container has occurred.

In the recent past, a number of different tamper-resistant/tamper-evident closure constructions have been proposed and produced. U.S. Pat. No. 4,291,813 shows one arrangement, illustrating a dispenser employing a retainer ring on a screw cap, the ring being pivotally connected to the cap along a thin annular line of weakness and being capable of forced movement over a cooperable lip on the neck of a container. Following assembly at the facility where the product is being filled, the cap is installed on the container and at the same time the ring shifted downwardly over the container lip, thereby retaining the cap against unauthorized removal. Upon initial use of the dispenser the cap, being unscrewed, causes the ring to separate along the line of weakness. In this particular construction, the ring is intended to remain with the container following removal of the cap.

Yet another construction is illustrated in U.S. Pat. No. 3,650,428, involving a dispenser having external ratchet teeth disposed on the exterior surface of the neck of a container. These teeth cooperate with internal teeth on a locking ring which is carried by the closure cap. The connection between the latter and ring is in the form of multiple frangible webs that remain intact prior to initial use of the dispenser, but which are ruptured when the cap is first unscrewed.

Other arrangements involving tamper-evident closures are illustrated in U.S. Pat. Nos. 4,156,490; 4,299,328 and 3,348,718. In U.S. Pat. No. '490, the retainer ring is provided with internal left-hand threads which, during unscrewing of the cap, operate to force the ring in an axially downward direction, thereby enhancing the tensile break-away force applied to the webs that connect the cap to the ring. U.S. Pat. No. '328 shows a somewhat similar dispenser having a screw cap connected to a retainer band by a series of thin webs which are intended to break away during initial use. U.S. Pat. No. '718 involves a metal closure for a bottle, wherein a relatively thin shell is placed over the container neck and thereafter a crimping operation performed which imparts threads to the cap, and at the same time creates a shoulder in a part that fits under a cooperable external shoulder in the neck of the container. The upper and lower portions of the closure break apart when the upper portion is initially unscrewed.

In all of the above patents, breakage or rupturing of the ribs provides the desired visual indication to the user that the device may have been previously opened or otherwise tampered with in an unauthorized manner; in such cases the purity of the product is subject to question, as is its freshness. These considerations are especially important where foods or medicines are involved, as can be readily appreciated.

While many of the prior tamper-proof containers have met with varying degrees of success and have performed their intended functions reasonably well, it has still been necessary for the consumer to be especially circumspect as far as making close examination of the tamper-proof structures. That is, where thin webs have been employed in the past, their breakage has sometimes gone unnoticed unless it was accompanied by a substantial tear or deformation of the surrounding structure of the cap. In addition, some of the prior arrangements were relatively expensive to manufacture, and difficult to reproduce in large quantities and within the tolerances required in order to yield acceptable operation.

SUMMARY

The above disadvantages and drawbacks of prior tamperproof/tamper-evident closure constructions for dispensers are largely obviated by the present invention, which has for one object the provision of a novel and improved tamper-evident plastic closure cap construction which is extremely simple in its structure while at the same time providing a more pronounced and distinctive or attention-attracting indication of possible tampering or prior unauthorized use of the dispenser.

A related object of the invention is to provide an improved tamper-evident plastic closure cap construction as above set forth, wherein its various components can be molded as a single integral part, thus minimizing overall manufacturing costs.

Still another object of the invention is to provide an improved tamper-evident plastic closure cap construction as above characterized, which can be readily assembled to the container at the facility where the product is initially introduced or filled into the dispenser.

Yet another object of the invention is to provide an improved tamper-evident plastic closure cap construction of the kind indicated, which is reliable in its intended function, and which is easy for the consumer to open and use.

A still further object of the invention is to provide an improved one-piece plastic closure cap construction as outlined above, which can be readily assembled to an existing container in a permanent fashion so as to minimize the likelihood of separation of the parts, and wherein supplementary tamper-evident structures are employed at the junction of the closure cap construction and container, to indicate possible tampering in the nature of attempts to remove the entire closure cap construction from the container itself.

The above objects are accomplished by the provision of a tamper-evident plastic closure cap construction for use with a dispenser employing a container of the type having a discharge orifice and a fastener means thereon, said construction comprising a base portion, a closure portion connected thereto by means of a series of frangible webs which are intended to break when the closure portion is moved or unscrewed, and an improved indicator means that is associated with the webs and which provides a distinctive, highly visible indication if tampering or unauthorized opening of the dispenser have occurred. During assembly of the cap construction onto the container, the webs are stressed, so that upon their breaking they tend to shift laterally. The location of the indicator means is such that it is simultaneously shifted laterally with the webs when the latter are broken. The indicator means can take the form of a molded ring which is carried directly on the webs. The arrangement is such that by virtue of the unique combination of a raised indicator ring and one or more broken webs, there is provided a more striking indication of possible tampering than would be the case were the webs alone relied upon, since often such webs are physically small and breakage of one or two is not so likely to be observed by the consumer unless he is especially cautious about examining the container, prior to use.

The present objects are further accomplished by an improved tamper-evident dispenser construction, comprising in combination a container having a discharge orifice and a downwardly-facing annular retainer shoulder at its neck, and a closure cap construction comprising a base portion having a cooperable annular shoulder adapted to underlie and surround the annular retainer shoulder of the container neck, so as to permanently retain the base portion captive on the container neck against removal. This improved closure cap construction also includes a closure portion adapted to surround and seal off the discharge orifice of the container when the base portion is attached to the container. Frangible connector means joins the closure portion to the base portion, and is adapted to rupture if the portions should be forcibly shifted a predetermined amount with respect to each other. A structural indicator barrier is disposed at the lower part of the base portion of the closure cap construction, and is adapted to be deformed and to provide a distinctive visual indication of the same in the event that a tool or other instrument is employed in an attempt to pry off the base portion from the container neck.

Other features and advantages will hereinafter appear.

In the drawings, illustrating several embodiments of the invention:

Figure 7:
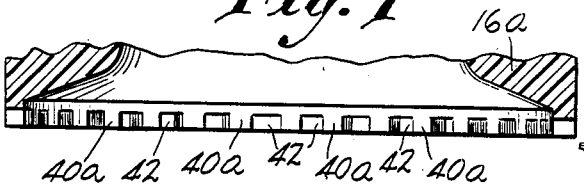

FIG. 7 is a fragmentary section of the lower part of the base portion of a modified closure cap construction, wherein a series of downwardly extending lugs or projections on the base portion is connected by thin bridges or webs of plastic, which are susceptible to deformation in the event that a tool were to be employed in an attempt to tamper with the cap construction, this arrangement constituting another embodiment of the invention.

Figure 8:
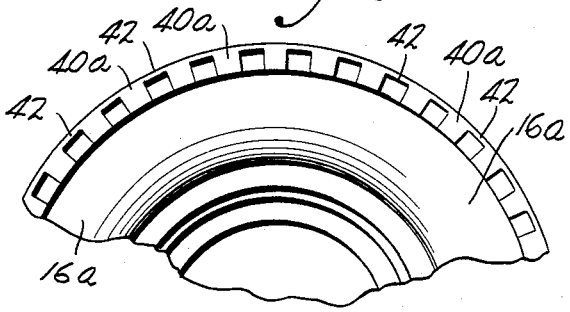

FIG. 8 is a fragmentary bottom plan view of the base portion of the closure cap construction of FIG. 7.

Figure 9:
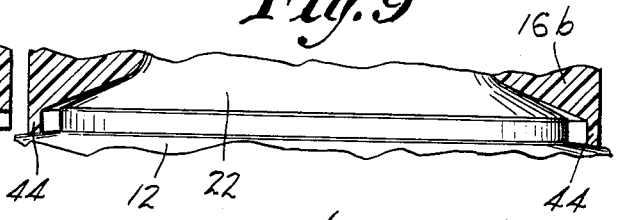

FIG. 9 is a view similar to FIG. 7, of a further modified closure cap construction wherein the bottom edge of the base portion thereof comprises a relatively fragile depending skirt that is intended to engage the outer surface of the container adjacent its neck, and which is susceptible to deformation in the event that a tool were to be employed in an attempt to tamper with the cap construction, this arrangement constituting still another embodiment of the invention.

Figure 10:
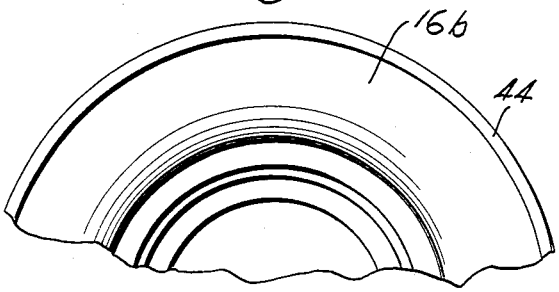

FIG. 10 is a fragmentary bottom plan view of the base portion of the closure cap construction of FIG. 9.

Figure 11:
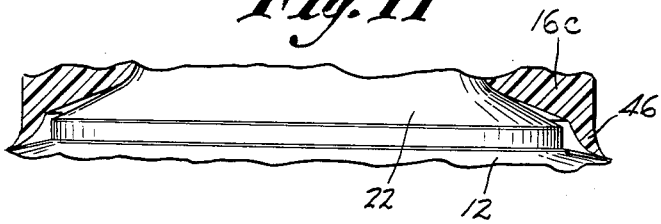

FIG. 11 is a view similar to that of FIG. 7 of a still further modified closure cap construction wherein the bottom edge of the base portion thereof comprises a depending skirt having a feathered configuration, also susceptible to deformation in the event that a tool were to be employed in an attempt to tamper with the cap construction, this arrangement constituting yet another embodiment of the invention.

Figure 12:
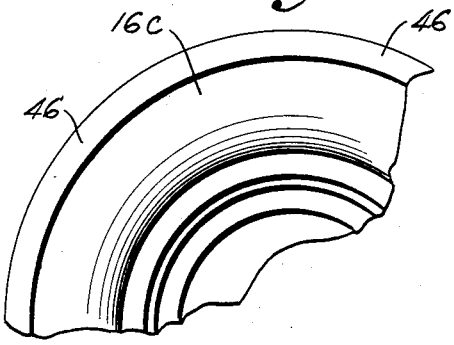

FIG. 12 is a fragmentary bottom plan view of the base portion of the closure cap construction of FIG. 11.

Figure 13:
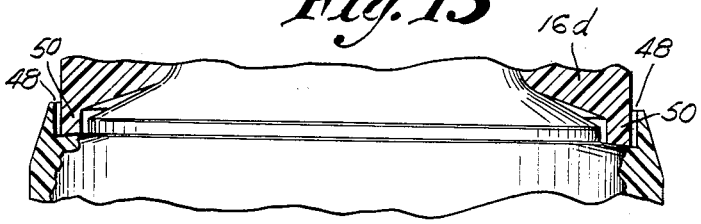

FIG. 13 is a view similar to that of FIG. 7, showing yet another modification, wherein the neck of the container is provided with an upwardly facing annular trough, and wherein the bottom edge of the base portion of the closure cap construction comprises a depending skirt adapted to be seated in the trough, thereby to minimize the possibility of access thereto by a tool or other instrument.

Figure 14:
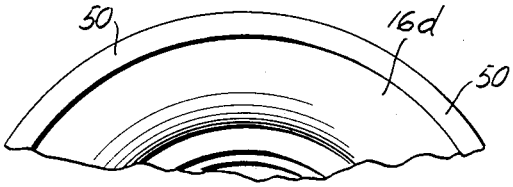

FIG. 14 is a fragmentary bottom plan view of the base portion of the closure cap construction of FIG. 13.

Figure 1:
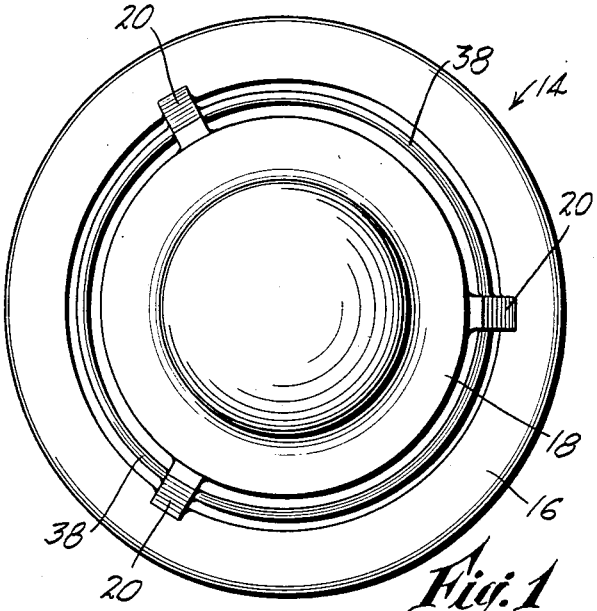
FIG. 1 is a top plan view of the improved tamper-evident closure cap construction of the present invention, particularly illustrating a base portion, a closure portion connected thereto by means of a series of frangible webs, and an indicator means adapted to be shifted laterally or upward in the event that one or more of the webs is ruptured.
Figure 4:
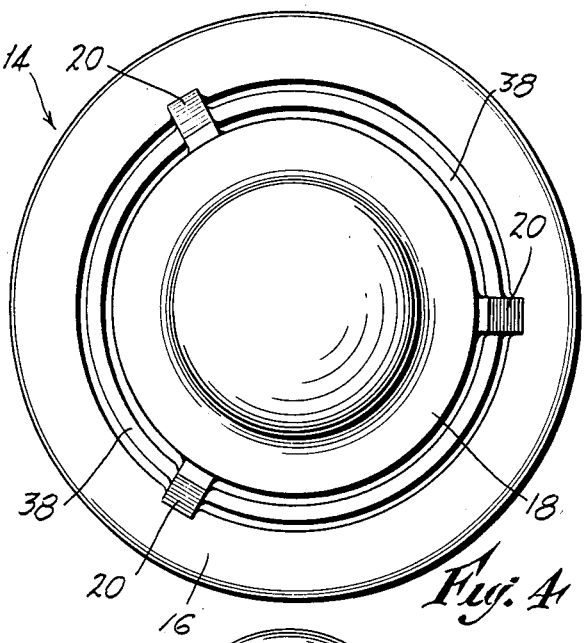
FIG. 4 is a top plan view of the plastic closure cap construction as it would appear immediately following its removal from a mold.
Figure 2:
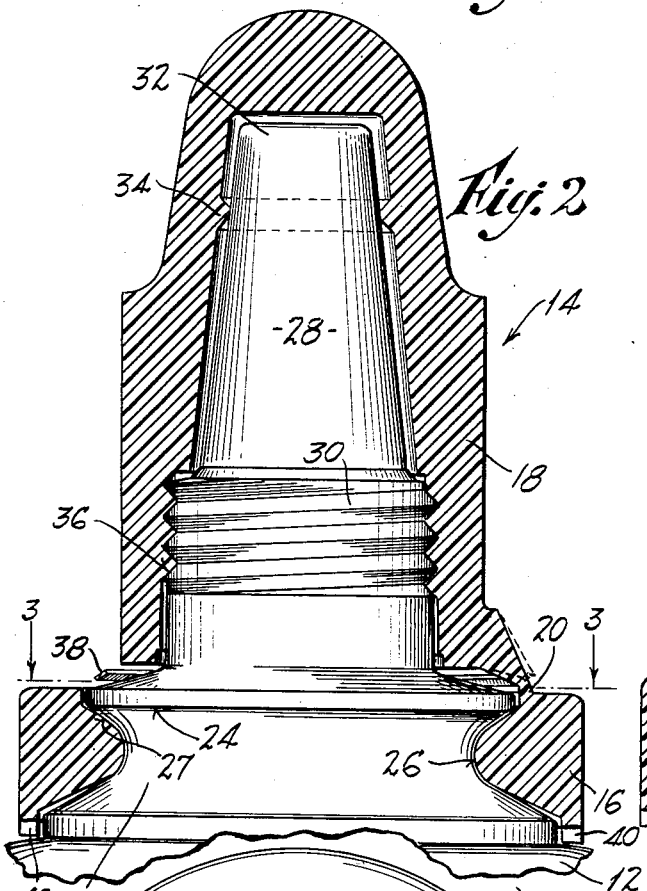
FIG. 2 is a vertical sectional view of the tamper-evident plastic closure cap construction of the present invention, shown assembled to a container.

Referring first to FIGS. 1 and 2 there is illustrated a dispenser generally designated by the numeral 10, comprising a container 12 and a plastic closure cap construction 14. The closure cap construction 14 comprises a base portion 16 and a closure portion 18 connected therewith by means of a plurality of thin, frangible webs or ribs 20, as illustrated in FIG. 1. Three such webs are shown in this figure, circumferentially spaced from one another by 120°.

The container 12 has a neck 22 with a fastener means comprising a downwardly facing shoulder 24 constituting one wall of an annular recess 26, the shoulder 24 being adapted for engagement by a cooperable shoulder 27 on the cap construction 14 when the latter is assembled as in FIG. 2. The container 12 optionally has an upwardly extending spout portion 28 with external threads 30, and an orifice or discharge portion 32 through which the contents of the dispenser are discharged. The closure portion has an internal annular sealing bead 34 which bears against the conical exterior surface of the spout portion 28 as in FIG. 2. The closure portion also has internal threads 36 that are adapted to engage the threads of the spout, all in the usual manner.

In accordance with the present invention, there is provided a novel indicator means associated with the webs 20, to alert the consumer of the possibility of the container having been previously opened or tampered with, the indicator means in the present instance taking the form of a generally circular transverse indicator member or ring 38 that encircles the closure portion 14 adjacent the location of the webs 20, and which is intended to be laterally shifted by the webs 20 in the event that the latter are ruptered, as by moving or twisting the closure portion 18 with respect to the base portion 16.

Figure 5:
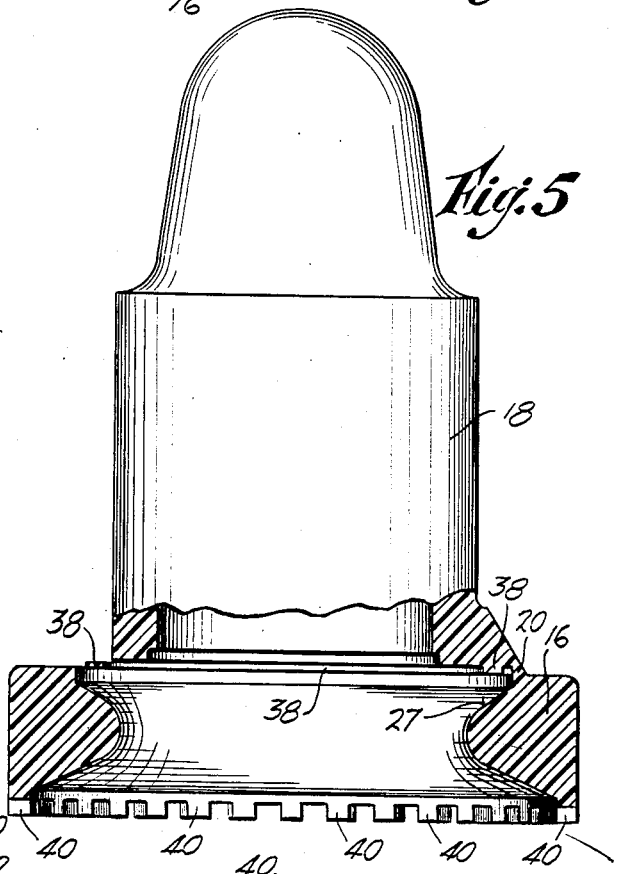
FIG. 5 is a view partly in elevation and partly in vertical section, illustrating the plastic closure cap construction of FIG. 4 as it would appear immediately following its removal from the mold.
Figure 3:
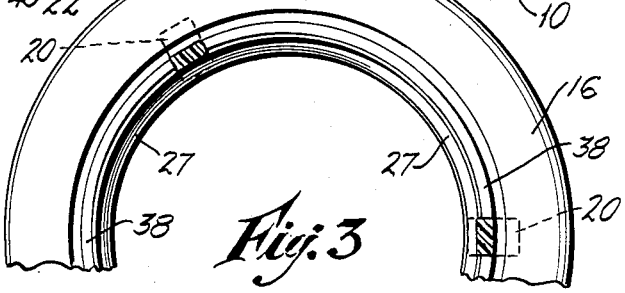
FIG. 3 is a fragmentary horizontal section taken on the line 3—3 of FIG. 2.

Further in accordance with the invention, the webs 20 are stressed in a radially inward direction and are under tension when the base portion 16 of the cap construction 14 is assembled to the container 12. FIG. 5 illustrates the closure cap construction 14 immediately upon its being stripped from a mole. It is noted that both the indicator ring 38 and webs 20 are in a relatively collapsed condition, the webs 20 in FIG. 5 occupying a radial position which is outside that shown in FIG. 2.

During installation of the cap construction 14 on the container 12, the base portion 16 is permanently expanded somewhat when it is seated in the recess 26, and the expansion applies a tensile force to the webs 20 such that they are stretched and held in a radially inward position, as shown in solid outline in FIG. 2. The indicator ring 38 accordingly occupies a lowered position, also shown in solid outline in this figure.

By the invention, once turning or moving of the closure portion 18 occurs, one or more of the webs 20 breaks and the release of the tensile force that had been applied to them allows them to spring radially outwardly and upwardly to the position indicated in dotted outline in FIG. 2. In the present construction, the indicator ring 38 is secured to the webs near their points of attachment to the base portion 16, and accordingly the ring 38 is also shifted radially outwardly and upwardly to a second position which is above that illustrated in FIG. 2. It has been found that this upward movement of the indicator ring 38 creates a pronounced and distinctive appearance at the area of the junction between the base portion 16 and closure portion 18, to the extent that it becomes readily apparent to the consumer that the dispenser has either been opened or otherwise tampered with. Naturally, once the webs 20 have been severed, it is impossible to restore their integrity, especially in view of the spring bias effect afforded them by virtue of their having been first stretched and thereafter broken.

In the present construction, the lines of weakness of the webs 20 are close to their points of attachment to the base portion 16, i.e. near the section line indicated 3—3 in FIG. 2. The indicator ring 38 is disposed above these lines of weakness, as shown.

Figure 6:
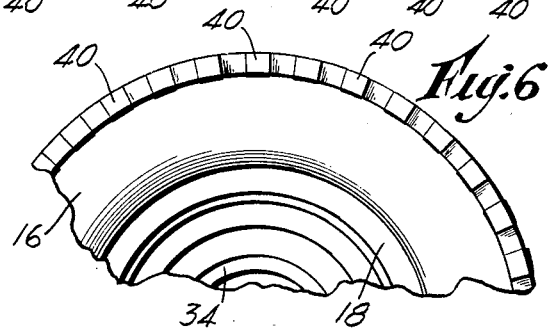
FIG. 6 is a fragmentary bottom plan view of the closure cap construction of FIG. 5.

Also in accordance with the invention, there is provided an additional tamper-evident feature which indicates damage to the dispenser, due to prior attempts to remove the base portion 16 from the neck of the container 12. Referring to FIGS. 5 and 6, there is provided on the lower part of the base portion 16 a weakened edge in the form of a series of relatively fragile depending lugs or projections 40 which are adapted to overlie the area of the container 12 adjacent the juncture of its neck and body. Such lugs may be of roughly square configuration as illustrated, and can be separated by small spaces as shown. In practice, they are sufficiently fragile so that any attempt to employ a tool in order to unseat the base portion 16 from the recess 26 would result in permanent tearing or deformation of at least some of these lugs 40, thus providing an indication of possible tampering.

Another embodiment of the invention is shown in FIGS. 7 and 8 wherein a similar closure cap construction is provided, having a base portion **16*a*, with a series of lugs 40*a* that are somewhat similar to those of FIGS. 5 and 6, except that they are joined by thin strips or bridges of plastic material, indicated 42. Being thinner, the bridges 42 are even more fragile than the lugs, and this arrangement could be employed as an alternate construction. Again, any attempts to pry the base portion 16*a* out of the recess 26 of the container would likely cause permanent deformation of both the lugs 40*a* and the bridges 42**, thus providing an indication of possible tampering.

Still another embodiment of the invention is shown in FIGS. 9 and 10; in the base portion **16*b* there has been provided, in place of the lugs 40*a* of FIGS. 7 and 8, a continuous flash or thin skirt of material 44**, which is generally circular and which overlies the area around the container neck. The skirt is sufficiently fragile as to be readily deformable and subject to tearing if attempts at tampering are made.

A somewhat similar arrangement is shown in FIGS. 11 and 12, wherein a base portion **16*c* having a skirt 46 is provided, characterized by a feathered edge. This edge is adapted to directly engage the body of the container 12 as clearly shown in FIG. 11, forming what is seen to be a continuous conical surface at the juncture therewith. In comparison to the construction of FIGS. 9 and 10, the edge 46** would be more susceptible to tearing, and would thus provide a more sensitive indicator.

Yet another embodiment of the invention is shown in FIGS. 13 and 14. In this construction, the base portion is designated **16*d*, and area around the neck of the container is provided with an upwardly facing annular trough 48 adapted to receive the lower edge 50 of the portion 16*d*. The function of the trough 48** is to limit the access to this edge and thus discourage attempts to unseat the base portion from the container.

From the above it can be seen that I have provided novel and improved tamper-evident closure cap constructions which are extremely simple in their structure, and which provide a more positive and definitive indication that tampering with the dispenser may have occurred. The individual components of the closure cap construction, i.e. the base portion 16, closure portion 18, webs 20 and ring 38, can all be molded as a single integral piece, thus minimizing manufacturing costs, and reducing expense involved with assembly. It has been found that the sensitivity provided by the arrangements illustrated increases the effectiveness of the tamper-evident feature over those arrangements of the prior art devices where reliance is placed solely on the use of a closure cap, a retainer ring and frangible webs connecting the two parts.

The devices of the present invention are thus seen to represent a distinct advance and improvement in the technology of tamper-proof and tamper-evident closures.

Each and every one of the appended claims defines an aspect of the invention which is separate and distinct from all others, and accordingly each claim is to be treated in this manner when examined in the light of the prior art devices in any determination of novelty or validity.

Variations and modifications are possible without departing from the spirit of the claims.

What is claimed is:

1. A tamper-evident plastic closure cap construction for use with a container of the type having a discharge orifice and having a fastener means thereon, comprising in combination:

(a) a base portion provided with means cooperable with the fastener means of the container to lock said base portion to the container against removal therefrom, said base portion being constituted as a piece separate from the container, (b) a closure portion adapted to surround and seal off the discharge orifice of the container when the base portion is attached to the container, (c) frangible connector means including a plurality of frangible webs joining the closure portion to the base portion, said webs rupturing adjacent their points of attachment respectively to said base portion, and remaining essentially intact at other points of attachment respectively to said closure portion when said closure and base portions are forcibly shifted a predetermined amount with respect to each other, (d) said frangible webs being normally stressed in a downward direction and swinging upwardly upon said rupturing occurring, thereby providing a visual tamper-evident indication in response to rupture of the webs.

2. The invention as defined in claim 1, wherein:

(a) said webs are three in number, and are circumferentially spaced from one another by roughly 120 degrees.

3. The invention as defined in claim 1, and further including:

(a) a skirt of annular configuration depending from the base portion and adapted to overlie and surround upper parts of the container body, (b) said skirt being sufficiently fragile so as to readily become deformed in the event that a tool is inserted between it and the container body, and thereby provide an indication that tampering may have occurred.

4. The invention as defined in claim 1, and further including:

(a) a skirt of annular configuration depending from the base portion and adapted to overlie and surround upper parts of the container body, (b) said skirt being characterized by a series of circumferentially disposed downwardly projecting lugs defining spaces therebetween, (c) the lugs being fragile, and adapted to become deformed in the event that a tool is inserted between the skirt and the container body, to thereby indicate that tampering may have occurred.

5. The invention as defined in claim 4, and further including:

(a) a series of thin breakable strips bridging at least some of the spaces between the downwardly projecting lugs, (b) said strips being adapted to rupture and provide an indication of tampering in the event that a tool is employed to attempt removal of the base portion from the container neck.

6. The invention as defined in claim 1, and further including:

(a) a skirt of annular configuration depending from the base portion and adapted to overlie and surround upper parts of the container body, (b) said skirt being characterized by a feathered edge which is fragile and which closely conforms to the contour of the outer surface of the body of the container, said skirt being adapted to become deformed in the event that a tool is inserted between it and the container body, (c) deformation of said feathered edge indicating that tampering may have occurred.

7. The invention as defined in claim 1, wherein:

(a) said container comprises an annular, upwardly facing trough adjacent its neck, (b) a depending skirt on the base portion, having a downwardly facing edge, (c) said edge being adapted to be received in said trough so as to limit access thereto and minimize the possiblity of there occurring undetectable tampering with the skirt.

8. The invention as defined in claim 1, wherein:

(a) the neck of the container has an annular recess, one wall thereof constituting the said fastener means, (b) said means for attaching the base portion to the container comprising a radially inwardly extending projection adapted to be received in and permanently retained in the annular recess, following initial assembly of the closure cap construction to the container.

9. The invention as defined in claim 1, wherein:

(a) said container neck has a tubular spout containing said discharge orifice, (b) said spout having an exterior surface provided with screw threads, and (c) cooperable screw threads on the interior of the closure portion whereby the latter can be screwed onto and unscrewed from the said spout, following initial use of the container.

10. The invention as defined in claim 1, and further including:

(a) indicator means comprising an indicator member, said indicator member being disposed in a first, lower position with respect to the closure portion when the webs are intact, and being sprung upwardly to a second, raised position by the resilience of the webs in the event that the latter are ruptured as a result of tampering or initial use of the container.

11. The invention as defined in claim 10 wherein:

(a) the base portion, closure portion, connector means and indicator means are all integral with one another.

12. A tamper-evident dispenser construction, comprising in combination:

(a) a container having a discharge orifice and a downwardlyfacing annular retainer shoulder at its neck, (b) a closure cap construction comprising a base portion having a cooperable annular shoulder adapted to underlie and surround the annular retainer shoulder of the container neck, so as to permanently retain the base portion captive on the container neck and hold it against removal therefrom, (c) a closure portion adapted to surround and seal off the discharge orifice of the container when the base portion is attached to the container, (d) frangible connector means comprising frangible webs, joining the closure portion to the base portion, and adapted to rupture if said portions should be forcibly shifted a predetermined amount with respect to each other, and (e) an indicator and barrier means disposed at the lower part of the base portion of the closure cap construction and beneath the lowermost parts of the frangible webs, said indicator and barrier means overlying part of the container body adjacent its neck and comprising a weakened edge of the base portion adapted to be deformed and provide a visual indication of the same in the event that a tool or other instrument is employed in an attempt to pry off the base portion from the container neck.

13. The invention as defined in claim 12, wherein:

(a) the weakened edge comprises a plurality of fragile spaced-apart lug formations extending downwardly from the lower part of the base portion of the closure cap construction.

14. The invention as defined in claim 13, and further including:

(a) a series of bridges extending between adjacent lug formations, (b) the thickness of the bridges in a radial direction being less than the thickness of the lugs whereby said bridges are more susceptible to breakage if engaged by a tool or other instrument.

15. The invention as defined in claim 12, wherein:

(a) the weakened edge comprises a fragile annular skirt extending downwardly from the lower part of the base portion of the closure cap construction.

16. The invention as defined in claim 15, wherein:

(a) the weakened edge is feathered, and is adapted to engage the body of the container and be spread apart thereby, (b) the juncture of the feathered edge and container body forming a generally continuous surface of conical configuration.

17. The invention as defined in claim 15 wherein:

(a) the neck of the container has an upwardly facing trough disposed below the retainer shoulder of its neck, (b) said trough being adapted to receive the fragile annular skirt of the base portion of the closure cap construction, so as to limit access thereto by a tool or other instrument.

18. A tamper-evident plastic closure cap construction for use with a container of the type having a discharge orifice and having a fastener means thereon, comprising in combination:

(a) a base portion provided with means cooperable with the fastener means of the container to securely attach said base portion to the container against removal therefrom, (b) a closure portion adapted to surround and seal off the discharge orifice of the container when the base portion is attached to the container, (c) frangible connected means including a plurality of frangible webs joining the closure portion to the base portion, said webs rupturing if said portions should be forcibly shifted a predetermined amount with respect to each other, (d) said frangible webs being normally stressed and becoming displaced laterally upon said rupture occurring, and (e) indicator means connected with and extending from said webs, providing a visual tamper-evident indication in response to rupture of the webs, (f) said webs having lines of weakness nearer their respective points of attachment to the base portion than to their points of attachment to the closure portion, (g) said indicator means comprising an annular yieldable ring encircling the orifice of the container and being connected with the frangible webs above their lines of weakness, respectively, such that rupture of the webs will result in the ring being retained by at least some of the webs and swung upwardly with respect to the closure portion, thereby providing said tamper-edivent indication.

19. A tamper-evident plastic closure cap construction for use with a container of the type having a discharge orifice and having a fastener means thereon, comprising in combination:

(a) a base portion provided with means cooperable with the fastener means of the container to securely attach said base portion to the container against removal therefrom, (b) a closure portion adapted to surround and seal off the discharge orifice of the container when the base portion is attached to the container, (c) frangible connecter means including a plurality of frangible webs joining the closure portion to the base portion, said webs rupturing if said portions should be forcibly shifted a predetermined amount with respect to each other, (d) said frangible webs being normally stressed and becoming displaced laterally upon said rupture occurring, and (e) indicator means connected with and extending from said webs, providing a visual tamper-evident indication in response to rupture of the webs, (f) said indicator means comprising an indicator ring extending transversely of and being integral with said webs, (g) said indicator ring experiencing lateral displacement upon rupture of said webs and thereby providing said tamper-evident indication.

20. A tamper-evident plastic closure cap construction for use with a container of the type having a discharge orifice and having a fastener means thereon, comprising in combination:

(a) a base portion provided with means cooperable with the fastener means of the container to lock said base portion to the container against removal therefrom, (b) a closure portion adapted to surround and seal off the discharge orifice of the container when the base portion is attached to the container, (c) frangible connector means including a plurality of frangible webs joining the closure portion to the base portion, said webs rupturing if said portions should be forcibly shifted a predetermined amount with respect to each other, (d) said frangible webs being normally stressed in a downward direction and swinging upwardly on the lower periphery of the closure portion, upon said rupturing occurring, and (e) indicator means connected with and extending from said webs, providing a visual tamper-evident indication in response to said upward swinging of the webs.

* * * * *